United States Patent [19]

Oder

[11] 4,157,954

[45] * Jun. 12, 1979

[54] METHOD FOR IMPROVING PRODUCTION RATES DURING BENEFICATION OF PARTICLE DISPERSIONS

[75] Inventor: Robin R. Oder, Novato, Calif.

[73] Assignee: J. M. Huber Corporation, Locust, N.J.

[ * ] Notice: The portion of the term of this patent subsequent to Oct. 12, 1993, has been disclaimed.

[21] Appl. No.: 731,388

[22] Filed: Oct. 12, 1976

[51] Int. Cl.[2] ..... B03G 1/00

[52] U.S. Cl. ..... 209/214; 209/232

[58] Field of Search ..... 209/214, 213, 223 R, 209/232; 210/222, 223

[56] References Cited

U.S. PATENT DOCUMENTS

| | | | |
|---|---|---|---|
| 3,027,678 | 12/1971 | Marston | 210/222 |
| 3,471,011 | 10/1969 | Iannicelli | 209/214 |
| 3,567,026 | 3/1971 | Kolm | 210/222 |
| 3,985,646 | 10/1976 | Oder | 209/223 R |
| 4,005,008 | 1/1977 | Oder | 209/223 R |
| 4,079,002 | 3/1978 | Iannicelli | 210/22 |

OTHER PUBLICATIONS

IEEE Trans. on Magnetics, vol. Mag-9, No. 3, Sep. 1973, 303-306.

*Primary Examiner*—Robert Halper

*Attorney, Agent, or Firm*—Harold H. Flanders

[57] ABSTRACT

Method for improving production rates during magnetic separation of magnetically attractable particles dispersed in a fluid carrier, as for example during separation of weakly magnetic discoloring contaminants dispersed in a clay slurry. The dispersion is passed through a ferromagnetic filamentatious matrix within a canister disposed in a magnetic field. The matrix is part of a magnetic separator system characterized by a separation parameter p, where p is a function of the geometry and magnetic and electrical properties of the separating apparatus; and of the rheological and magnetic properties of the dispersion. By determinatively adjusting the packing density of the matrix in the canister, and/or by utilizing appropriate solids content in the slurry, production rate is controlled or optimized for a given brightness increase in the clay.

1 Claim, 3 Drawing Figures

METHOD FOR IMPROVING PRODUCTION RATES DURING BENEFICATION OF PARTICLE DISPERSIONS

BACKGROUND OF INVENTION

This invention relates generally to the technology of magnetic separation, and more specifically to method and apparatus for removal of magnetically more susceptible minute particles, often present in minor concentration as coloring impurities, from aqueous slurries of minute mineral particles—such as obtained by dispersing clay, e.g., a crude kaolin clay, in water.

The iron content of commercial deposits of kaolin clay is generally on the order of from approximately 0.2% to 2%. Even recent publications indicate a continuing dispute as to whether the iron contaminants are in discrete form or in a combined form within a kaolin lattice structure. While the form of this iron in clay has not been definitiely established, recent evidence indicates that a portion is concentrated in or associated with nonkaolin contaminants such as titanium oxides, etc. Whatever its form, iron contamination reduces brightness in clay and the degree of discoloration of the clay generally increases with the amount of iron present.

In the foregoing connection, it has been known for some time that magnetically attractable contaminants can to a degree be removed from aqueous slurries of the aforementioned clays by imposition on the slurry of a high intensity magnetic field gradient. The forces produced upon the particles by the magnetic field gradient, effect differential movements of mineral grains through the field, in accordance with the magnetic permeability of the minerals, their size, mass, etc. The difficulties of utilizing magnetic separation are compounded in the present environment by the fact that the contaminants of greatest interest are are relatively low attractability. The primary magnetic discolorant found in Middle Georgia clays, for example, is iron-stained anatase ($TiO_2$). This impurity is very small in size and only very weakly magnetic. Indeed by some early views contaminants of this general type were considered to be nonmagnetic. For example, see A. F. Taggart, *Handbook of Mineral Dressing*, p. 13-02 (1960), which shows on a scale of 100.00 taking iron as a standard, that the relative attractability of $TiO_2$ is 0.37.

In the copending patent applications of Joseph Iannicelli, Ser. No. 19,169, filed Mar. 13, 1970; Ser. No. 309,839, filed Nov. 27, 1972; and Ser. No. 340,411, filed Mar. 12, 1973 which applications are assigned to the assignee of the instant application, there are disclosed method and apparatus, which in comparison to the prior art, are outstandingly effective in achieving magnetic separation of the low susceptibility impurities referred to. In accordance with the disclosure of said applications, a container adapted to have the slurry passed therethrough is filled with magnetizable elements (preferably steel wool), constituting a flux conductive matrix, which matrix serves both for diverting the slurry flow into multitudinous courses, and for concentrating magnetic flux at myriad locations therein, so as to collect the weakly susceptible particles from the slurry. This container or canister, as it is referred to therein, is preferably of non-magnetic construction and disposed end-wise or axially between confronting surfaces of ferromagnetic pole members, between which a magnetic field having a high intensity is produced throughout the matrix. Preferably the said canister is generally cylindrical in form, and is oriented between the pole members with its axis vertical, its ends being adjacent to and covered by the pole members. In the first two of the cited Iannicelli applications, the flow of slurry through the canister and matrix is in the same general direction (i.e., axial) as the high intensity magnetic field. In the last listed of the said applications, it is disclosed that certain important advantages accrue from flowing the slurry through the canister in such manner that the predominant direction of flow through the matrix is radial, i.e., from the outside diameter (O.D.) thereof toward the axis, or from the axis toward the O.D.

The slurry, as taught in the said Iannicelli applications, is passed through the container at a rate sufficient to prevent sedimentation, yet slow enough to enable the collection and retention of weakly magnetic particles from the flow onto the matrix elements. The magnetic field which is applied during such collection, is taught in the said applications to have an intensity of at least 7,000 gauss, and preferably has a mean value in the matrix of 8,500 gauss or higher. At such field strengths magnetic saturation of the matrix occurs. After a sufficient quantity of magnetics are collected, slurry flow is discontinued, and with the field cut off the matrix is rinsed and flushed.

While the Iannicelli apparatus and method above-described hae indeed been found highly effective for the desired purposes, it has nevertheless been observed in practice that apparatus and methods yielding a given set of results in a first environment would provide unanticipated (and in some instances, unacceptable) results in a differing environment. For example, a specific canister and matrix operating upon slurries having different particle characteristics and different viscosities, might display unexpectedly poor results, even when the same field intensities and flow conditions were utilized. In consequence operation and design of systems of the described type, have been based on trial and error, and on such guidance as could be provided by application of the intuitive sense. Such approach, however, has not enabled development of optimized systems, nor has it established correct modes of operation where trade-offs are required in the system operation.

For example, up to the present time, it has not been appreciated what options were available were one desirous in systems of the foregoing type of reducing retention time for the slurry in the separation (thereby increasing production rates), without sacrificing brightness in the resultant product. In the *Bulletin of the American Physics Society* Vol. 16 (1971) at page 350, for example, C. P. Bean reports an equation pertinent to removal of suspended particles in a fluid passed through a magnetic field, without however teaching any practical applications or limitations for the mathematical concepts mentioned.

In my copending application, Ser. No. 495,712, filed Aug. 8, 1974, and entitled METHOD AND APPARATUS FOR MAGNETIC BENEFICIATION OF PARTICLE DISPERSIONS, I disclose my finding that performance of separating systems of the type disclosed in the cited Iannicelli applications, by which it is meant reduction of discoloring magnetic contaminants and brightness improvement in the remaining product, is given in terms of a parameter p. This parameter, henceforth referred to as the "Separation parameter," is given by the expression:

$$p=Q/\eta(d/D)^2MH\tau X(1-X) \quad (1)$$

where Q is the magnetic susceptibility and d the means particle diameter of the attractable contaminant particles, $\eta$ is the viscosity of the fluid slurry including the particles, M is the magnetization and D the mean diameter of the filaments of the separation matrix, X is the fraction of the canister volume occupied by the matrix, H is the intensity of the applied magnetic field, and $\tau$ is the retention time in the said field. The parameter p is related to the factor $C_o/C$, representing the ratio of contaminant particles (C) entering the separation system to the particles ($C_o$) leaving the system, by the expression:

$$C_o/C = e^{-\alpha p} \quad (2)$$

where $\alpha$ is a numerical coefficient characteristic of the system. By determinately selecting among the controllable variables of the separation system a desired $C_o/C$ ratio is yielded. In a typical instance for example, the factors Q, $\eta$, M and d are presented as essentially fixed quantities, so that a desired $C_o/C$ ratio is provided by selection among the controllable factors D, H, $\tau$, and X.

In accordance with the foregoing, it may be regarded as an object of the present invention, to provide a method for magnetic separation of low magnetic susceptibility discolorant particles from aqueous clay slurries, whereby production rate may be controlled or optimized for a given brightness increase in the clay.

It is another object of the present invention, to provide method and apparatus for magnetic separation of low magnetic susceptibility particles from aqueous slurries of said particles with comparatively larger number of non-magnetic particles, according to which determinative trade-offs may be provided among the controllable variables in the separation system, thereby tailoring the system performance characteristics to the materials being treated, to desired production rates, available magnetic field intensities, and so forth.

SUMMARY OF INVENTION

Now in accordance with the present invention, the foregoing objects, and others as will become apparent in the course of the ensuing specification, are achieved by passing the clay dispersion through a ferromagnetic filamentatious matrix within a canister disposed in a magnetic field. The matrix is part of a magnetic separator system characterized by a separation parameter p, where p is a function of the geometry and magnetic and electrical properties of the separating apparatus; and of the rheological and magnetic properties of the dispersion. By determinatively adjusting the packing density of the matrix in the canister, and/or by utilizing appropriate solids content in the slurry, production rate is controlled or optimized for a given brightness increase in the clay.

BRIEF DESCRIPTION OF DRAWINGS

The invention is diagrammatically illustrated, by way of example in the drawings appended hereto, in which.

DESCRIPTION OF PREFERRED EMBODIMENTS

Figure 1:
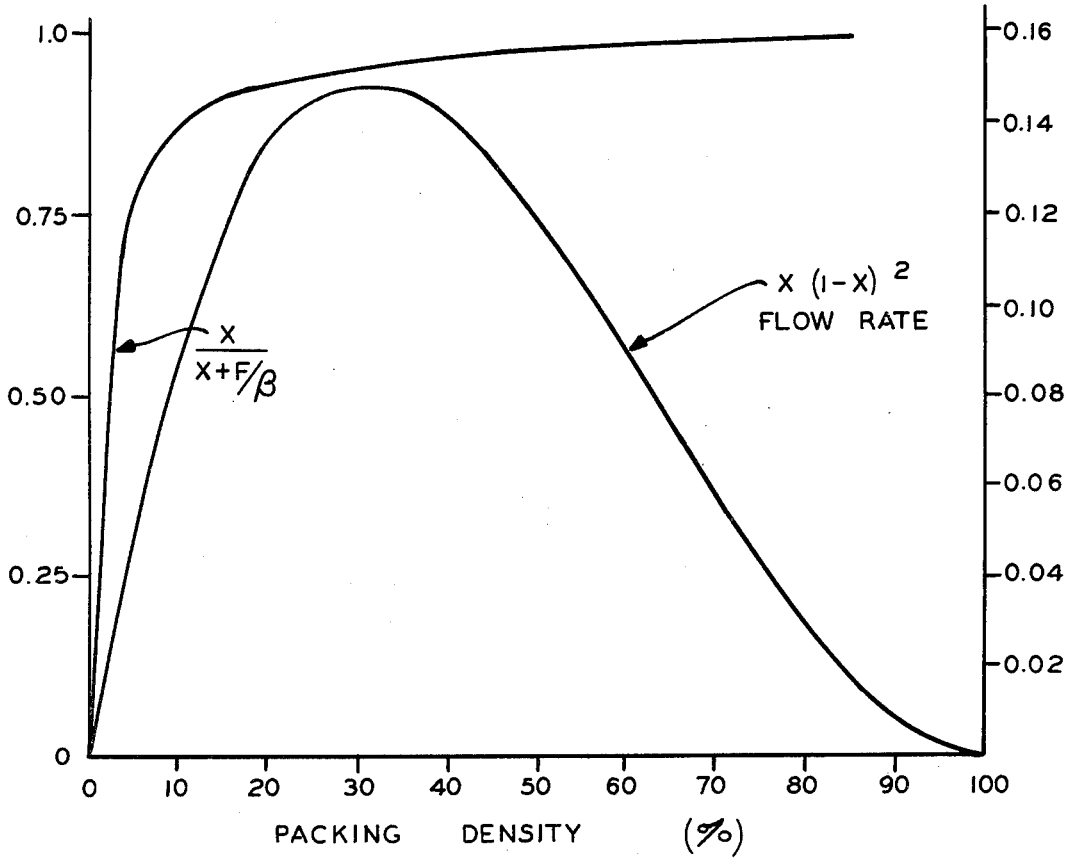
FIG. 1 is a graph, illustrating the effects of packing density X upon the duty cycle and flow rate, for a representative clay.

For purposes of the ensuing description, reference will be had primarily to magnetic separating systems of the type described in the aforementioned Iannicelli applications. These systems are intended primarily for application to processes for magnetic beneficiation of clay slurries, and particularly of aqueous slurries of kaolin clays. It will, however, be appreciated by those skilled in the art, that the same basic methods and apparatus taught herein, are utilizable in magnetic separation of other systems wherein magnetically attractable particles are dispersed in fluid carriers. The technology of the invention may thus, for example, find application to hemoglobin separation, to waste separation and removal of attractable water pollutants, as well as to beneficiation of various mineral systems other than those of principal interest herein.

As has been previously indicated in connection with the "Background" portion of this specification, the separating systems to which the invention has application, are characterized by use of a container or "canister" in which is packed a matrix of ferromagnetic material, through which (in the presence of a magnetic field) the dispersion (typically an aqueous clay slurry) is caused to flow. This matrix is composed of multitudinous elongate ferromagnetic elements of strip, ribbon-like, or wire-like form. These materials are characterized by their relatively fine widths or diameter, and for purposes of the present specification, will hereinafter be collectively referred to as "filamentatious," or individually as "filaments." These filamentatious materials are packed in the container space with individual filaments contacting, yet also spaced from others, so that as the flow of the slurry proceeds through the container the slurry is diverted into multitudinous diverse courses of minute widths, as by being caused to flow tortuously to and fro in the container between and among the matrix-forming elements, while the flux of the magnetic field being applied is concentrated by the multitudinous elements and the angles and other surface irregularities of the matrix at myriad points in those sources. A preferred material of this type is steel wool, as for example a so-called "fine" or "medium" grade of commercially available No. 430 stainless steel wool. The steel wool matrix provides a relatively large amount of open space; which, however, is so extensively interspersed by and between the wool, that the slurry is diverted into and through multitudinous flow courses having extremely narrow widths between the bordering magnetized strands of the wool. Accordingly, a relatively large volume of minute magnetic particles can be collected onto the strands before the flow of the slurry need be discontinued for flushing of the collected particles out of the canister.

The complex effects of all the slurry, magnet and collection matrix variables, are expressible as the single separation parameter p, with a single exponential dependence for the transmittance $T = C_o/C$ of particles through the system. The physical parameters of equation (1) above, can be regrouped so that p is given as the product of three independent parameters:

$$p = p_s p_m p_x \quad (3)$$

where $p_s$ is determined by the properties Q, $\eta$ and d of the slurry; $p_m$ is determined by design characteristics of the magnet, and geometry of the system, that is the factor H and $\tau$; and $p_x$ is determined by the type and state of the collection matrix. This relationship enables the practitioner to determinatively provide trade-offs among the controllable variables in the separating system so as to yield an optimal or at least acceptable result, even under conditions previously deemed impractical for efficient operation—e.g., in the presence of high solids content for the slurry being treated. By thus suitably manipulating the variables of the system, p can be made as large as is required for a given operation.

For clays of the type treated herein the dependence of brightness, B, upon the magnetic $TiO_2$ concentration C, approximates a linear relationship of the form:

$$b=b-sC, \tag{4}$$

where b is the brightness upon total $TiO_2$ removal, and s is the brightness reduction per unit increase of $TiO_2$ concentration. Using this expression, we can obtain a simple relationship between brightness, Bo, and concentration, $C_o$, at the output of the separator system and those at the input, B and C, as follows:

$$Bo-B\equiv\Delta B=sC(1-C_o/C) \tag{5}$$

If the separator system could completely remove the magnetic contaminants, then the maximum brightness improvement would be $$B_{mas}=sC \tag{6}$$

The more general expression for brightness improvement $\Delta B$ in clays derived from slurries treated in accordance with the invention is:

$$\Delta B=\Delta B_{max}(1-e^{-ap}) \tag{7}$$

The parameter $p_s$ in equation (3), above, shows the roles of the magnetic and rheological properties of the clay (or other) slurry, and is given by:

$$p_s=Qd^2/\eta \tag{8}$$

In this expression, Q is the magnetic susceptibility of the magnetic fraction of the slurry, d is the equivalent mean diameter of the magnetic particles, and $\eta$ is the slurry viscosity at the solids concentration and temperatures employed. The parameter $p_s$ is generally determined by the type of clay (or other dispersion) being processed. Since the larger the parameter p is the better the separation, it will be seen that with all other things being equal a course fraction will respond to separation better than a fine fraction. In general, it will be evident that in performing a separation, the parameter p is a presented quantity, not as readily controllable as the other factors to be discussed.

It will also be noted in reviewing equation (3) that p is proportional to the factor $\tau(1-X)X/\eta$. In this connection it is pointed out that clays treated in the past by magnetic separating apparatus, have principally been characterized by low percentage solids (typically to about 30%). The factor $\tau X/\eta$, however, prescribes a technique for processing much higher solids content slurries (e.g. up to about 60%). In particular one may compensate for the rapid increase in $\eta$ as the solids content goes up, by increasing $\tau$ or X to maintain a desired p. Since as a practical matter an undue increase in $\tau$ will hamper the production rate for the processing of the clay, it will usually be desirable to effect the adjustment through X. This aspect of the invention will be further discussed hereinbelow.

The role of magnet design and system geometry is reflected in the parameter $p_m$, given in terms of magnetic field intensity H, and retention time $\tau$, as:

$$p_m=H\tau \tag{9}$$

Generally speaking, optimum performance is achieved with high field strength and a long retention time. The magnetic field and retention times, however, are selected consistent with desired brightness performance, commercial production rates, and power consumption. More specifically, for a selected brightness value, it is normally desired to maximize production rate and minimize power consumption. If it is assumed that the slurry and matrix properties are fixed, the brightness will be determined by the value of $p_m$. Here it can be shown, to a first approximation, that the power per unit production rate, W, is given by $$W=K(H/\delta)p_m \tag{10}$$

where K is a constant, and $\delta$ is the canister diameter—assuming for analysis a cylindrical geometry. This indicates that to minimize power at maximum production rate and fixed $p_m$, the ratio $H/\delta$ should be minimized. Aside from demagnetizing effects on the wool, most efficient separation is thus effected at as low a field as practicable in a low aspect ratio canister. Recalling, however, that we desire $p_m=H\tau$ to remain fixed, a decrease in H must be compensated by an increase in $\tau$. Effectively therefore power consumption and production can pursuant to this analysis be traded off against one another.

In many instances the parameters $p_s$ and $p_m$ are fixed by the physical attributes of the separation system—such as e.g. the geometry and electrical design characteristics thereof—, and by the rheological properties of the dispersion to be treated thereby. Under such circumstances the parameter $$p_x=MX(1-X)/D^2 \tag{11}$$

of the collection matrix, lends itself to determinative control in order to enable a desired performance level. In this connection it is important to appreciate that the prior art has principally contemplated that magnetic separation be conducted with the separation matrix maintained in a magnetically saturated condition. In accordance with the present inventive concept, however, it has been found that saturation need not necessarily be employed; rather the degree of saturation is regarded herein as a factor to be traded off—among other things against the attendant power requirements which may be required to provide the field necessary to yield saturation. In other words, under given conditions the required value of p necessary to yield an adequate separation may be achieved with the matrix being less than saturated, with important attendant savings in utilized power. Further, however, it will be appreciated that the factor M in equation (1) will be determined once the external field is set and the choice of material for the matrix is made. The factors remaining in the expression (11) are the elements $X(1-X)$ and $1/D^2$. It is these contained parameters, namely, the fraction X of canister volume occupied by the matrix material, and the mean filamentary diameter D (assuming a wire-like material such as steel wool), which are most readily controlled. It may incidentally, be noted, that X is sometimes referred to herein as the "packing density," especially when expressed as a percentage—i.e., when multiplied by 100.

Concisely, it will be evident from the foregoing, that densely packed fine-sized filamentatious material, is preferred where high level separation is sought. The response of different clay fractions, e.g., is given in terms of the quantity $X(d/D)^2$. In Table I, estimated values are given for $X(d/D)^2$ for three types of clay fractions, "CWF," "Hydratex" and "Hydragloss" (all products of the assignee corporation):

Table I

RELATIVE SEPARABILITY FOR VARIOUS CLAY FRACTIONS

| | CWF | Hydratex | Hydra-gloss |
|---|---|---|---|
| Average Particle Diameter (microns) | 3 | .8 | .3 |
| Magnetic Susceptibility ($10^{-6}$cgs/gm) | 22.6 | 8.4 | 8.6 |
| Relative Separability | 263 | 6.9 | 1.0 |

It will be seen from Table I that a "CWF" fraction is about 250 times more separable than a "Hydragloss" fraction, and about 40 times more so than a "Hydratex" fraction. In Table I the particles assumed to be attracted for separation are, of course, the $TiO_2$ particles previously discussed. Recent findings, on the other hand, indicate that montmorillonite particles may indeed be a source of at least part of the discoloring contaminants. These latter particles are very feebly magnetic and have a smaller equivalent diameter d than do the assumed anatase particles. Table I therefore shows that these montmorillonite particles are not easily removed unless the separation parameter p is raised substantially above values used in the past.

The simplest and most economical manner in which p may be increased, is by utilizing densely packed, fine matrix material. The finer the particles to be separated, in general the finer should the filament material be for maximum efficiency of operation, except that (for reasons that will be seen subsequently herein) the filament size diameter should be preferably no smaller than the diameter of the particles to be removed. The effect of packing volume, X, appears in the separation parameter as $X(1-X)$. It will be evident that $\partial p/\partial X=o$, where $X=\frac{1}{2}$, and it is therefore seen that magnetic separation efficiency theoretically increases up to packing volume of 50%, at which the function $p=f(X)$ maximizes.

The dramatic effect of matrix material volume packing, upon production rate is shown in the following Table II:

Table II

BRIGHTNESS VERSUS RETENTION TIME FOR THREE PACKING VOLUMES

| | Brightness* | | |
|---|---|---|---|
| Retention Time (Min.) | 2 | 4 | 8 |
| Packing Volume (%) | | | |
| 4.4 | 87.5 | 88.7 | 89.9 |
| 8.7 | 88.9 | 90.2 | 90.3 |
| 15.5 | — | 89.9 | 89.9 |

*Control Brightness- 84.3
Magnetic Field - 15 koe

In this Table, all brightness data refer to measurements made according to the standard TAPPI procedure T636m-54. This Table illustrates that production rate (i.e., reduction in retention time) can be increased by increasing packing volume X, without sacrificing brightness. It will be noted in this connection that the elements on diagonals connected by arrows are equal in value to within experimental error (0.3 brightness points). This shows, for example, that upon increasing packing volume from 4.4% to 8.7% (almost double), retention time can be decreased from 4 to 2 minutes at the same brightness. Similar examples of increased production rate are to be found in the Table. The effect thus illustrated can be readily understood from the equation (1). Other things being equal, the separation parameter p is given by $$p \sim X(1-X)\tau \qquad (12)$$

If the retention time $\tau$ is decreased so as to just compensate for the increase in the quantity $X(1-X)$ arising from increase in packing volume X, keeping p constant, then the brightness will remain constant.

Greater brightness increases can be achieved utilizing the magnetic separation techniques discussed herein, where multiple-pass operations are utilized, particularly where the matrix is flushed between passes. This, it may be observed, is a finding contrary to the single-pass techniques which in the past were predominantly used. Thus a higher brightness improvement is achieved by two passes of a slurry at 40 gpm through the magnetic separator, than where one pass at 20 gpm is used. In order to illustrate this result, the Table III below, sets forth the brightness improvement for two types of coating clays, as a function of number of passes through apparatus of the type disclosed in the aforementioned Iannicelli apparatus. In each instance the same overall production rate was utilized. The said apparatus was operated during these tests with a field of 10,000 oersted, and a 5.5% packed matrix of 430 stainless steel medium felt wool served as the separating matrix.

Table III

Relationship Between Number Of Passes At Overall Production Rate (1.00 TPH) And Brightness Improvement

| Clay utilized | No. 2 Coating Clay | No. 1 Coating Clay |
|---|---|---|
| Control Brightness | 83.00 | 83.95 |
| Brightness Improvement of Composite After: | | |
| 1 pass (1.0TPH) | 3.45 | 2.50 |
| 2 passes (2.0TPH each) | 3.80 | 3.10 |
| 4 passes (4.0TPH each) | 4.30 | 4.05 |
| 8 passes (8.0TPH each) | 4.10 | 3.95 |

It may be noted in connection with Table III, that the designations "No. 1" and "No. 2" coating clays, are in accordance with standard practice in the industry where the three most widely recognized coating grade clays are respectively characterized as to fineness as No. 1, with particle size 92%—2 microns (i.e., 92% by weight of the particles have an equivalent spherical diameter less than 2 microns); No. 2, with particle size 80%—2 microns, and No. 3, with particle size 72%—2 microns. It will be understood that all of these designated standard coating clays (without limitation) may be processed by the apparatus and methods of the present invention.

The magnetic discoloring impurities removed by the present separating systems, are collected on surfaces of the ferromagnetic filaments where the magnetic force of attraction is a maximum, and the viscous drag arising from flow, a minimum. The steel wool and similar matrices used in the past have generally been designed with randomly arranged filaments, in consequence of which much of the optimum collection surfaces are lost. In accordance with the present invention, however, the filaments are preferably laid down in such manner that they present a relatively regular array, which is predominantly transverse to the magnetic field. The flow of slurry (or other dispersion) through the matrix is such that the flow is codirectional with the magnetic field. The net result of this arrangement is that the magnetic particles will tend to collect at the areas at the leading and trailing edges of the filaments where the surfaces of maximum magnetic field coincide with minimum viscous drag, i.e., the said edges are stagnation points in the flow pattern. It is preferable that the filament diameter in the separation matrix be no smaller than the diameter of the particles to be removed. In particular it will be evident that as the particles become larger than the filament size, the flow about the filament cross-section becomes asymmetric in consequence of which the viscous forces tending to drag off the particles collected become more pronounced.

Cleanout of filaments oriented in the separation system as mentioned above, is preferably carried out using a flush flow which is transverse to both the feed flow and filament length directions. The magnetic field is extinguished during this period. This assures that the filament surfaces whereat maximum drag for the flush water flow occurs, correspond to the filament areas at which most of the impurities have collected. In order to achieve a flush flow transverse to the feed flow one may initially provide a predominantly axial flow during the feed of slurry, as by introducing and withdrawing the slurry flow from opposite ends of the canister in the manner set forth in the cited Ser. No. 340,411 Iannicelli application. The flush flow may then be rendered predominantly radial, as by introducing it through a perforated tube coaxial with the canister. This latter type of arrangement is, e.g., shown in the cited Ser. No. 340,411 Iannicelli application. Suitable valving shifts the flow between the two configurations.

The preferentially arranged matrices described may comprise various arrangements such as layers of fine filamentary wires, each layer consisting of a sheet of generally codirectionally extending fine filaments held by a fine fabric network. Similarly steel fibers provided with the desired preferential orientation for the fibers thereof can be manufactured by sintering processes, or by wire cloth weaving techniques.

The production rate, $P_r$, for a clay slurry processed in the separation systems heretofore described, is given (in tons/hr) as:

$$P_r = \frac{60}{2000}\left(\frac{C}{C+F}\right)\frac{(1-X)\,VS}{\tau}, \tag{13}$$

where C is the number of canisters of clay collected during the total cycle of the separator system, and is the collection time of such cycle divided by the rentention time; and F is the effective number of canisters of flush water employed during such cycle. The factor (C/C+F) which may be referred to as the "duty cycle," is therefore the fraction of the total cycle length which is spent collecting beneficiated product. V in expression (13) is the canister volume; S the solids factor of the slurry (in lbs/gal); $\tau$ the retention time (in minutes); (1−X)V is the canister volume available for separation, and X is the matrix packing density.

It will be obvious from prior discussion concerning the separation parameter p, that the factors p and C determine the brightness of a clay processed by the separator apparatus—and that fixing these determines the brightness. Thus from equation (1):

$$\tau X(1-X)g/\eta = p = \text{constant} \tag{14}$$

at a fixed brightness, where g is a constant which reflects all other magnetic separation parameters such as strand size, magnetic field strength, magnetic susceptibility, etc. These may all be assumed held constant. Using this value for $\tau$, $$P_r = 60V/2{,}000gp(C/C+F)X(1-X)^2(S/\eta) \tag{15}$$

The factor (C/C+F) is the duty cycle; the factor $X(1-X)^2$ reflects the packing density; and the factor $S/\eta$ reflects the solids of the slurry being treated.

It may be assumed that the canister number C in an operating cycle is directly proportional to packing density—since surface area is proportional to packing density, and composite length proportional to area for collection. Therefore, $$C = \beta x \tag{16}$$

where $\beta$ is the proportionally constant.
Then $$C/C+F = \beta x/\beta x + F = X/X + F/\beta \tag{17}$$

Since $\beta X = C$ may be determined for achieving a particular brightening of a given clay, as may F and X, the factor $F/\beta$ may similarly be determined for such clay. Therefore, the duty cycle C/C+F is determinable from equation (17).

In FIG. 1 herein, the effect of packing density upon duty cycle is shown by plotting the function $X/X+F/\beta$ against the packing density. The curve shown is actually an average value for data obtained where a No. 2 coating clay, and a coarse coating clay characterized as including 44% of particles below 2$\mu$, are each processed to a given brightness increase. The factor $F/\beta$ for each said clay is very nearly the same, whereby the average curve shown is very close to the curves which would result were the data plotted separately for each clay. The effect of packing density X upon flow rate is shown in FIG. 1 by the curve plotting the factor $X(1-X)^2$ against the packing density. This factor $X(1-X)^2$ can be shown to be proportional to the flow rate.

The effect of packing density upon production rate at fixed brightness, is given by the term $$(X/X+F/\beta)\times(1-X)^2 \tag{18}$$

Figure 2:
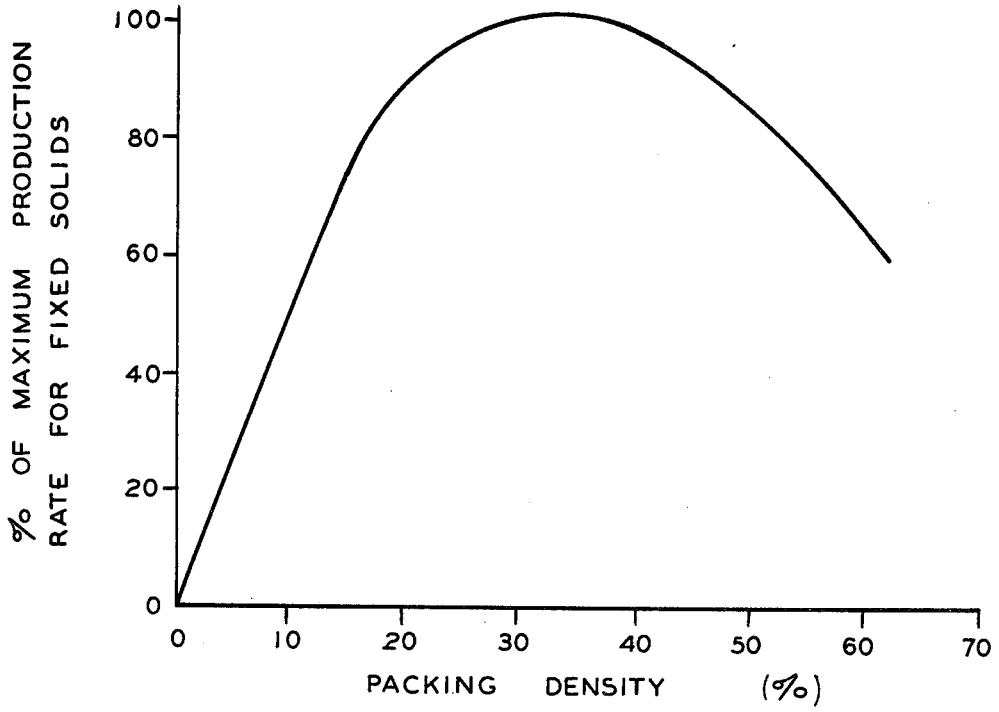
FIG. 2 is a graph illustrating the effects of packing density X upon production rate, for fixed solids in a representative clay.

Expression (18) is shown graphed in FIG. 2 as a percentage of maximum production rate for fixed solids. From this Figure it may be seen that the maximum of production (for a desired brightness increase) occurs at about 35% packing density; and it will be clear that maximization is mostly influenced by the trade-off between packing density and retention time.

It is significant to appreciate from FIG. 2, that about 90% of the maximum production rate can be realized at packing densities as low as 20%. By utilizing the lower densities (e.g. down to 20%), however, considerably fewer flushing problems are encountered—as compared to where densities at 35% (or greater) are employed.

Figure 3:
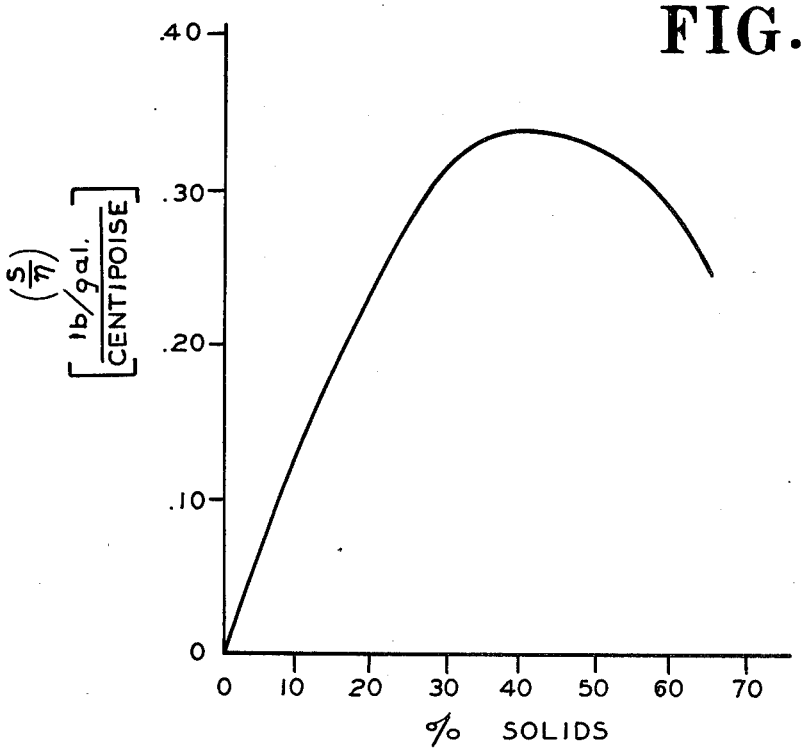
FIG. 3 is a graph showing the effects of slurry solids upon production rate.

The effects of slurry solids upon production rate can be seen from FIG. 3, wherein the quantity $S/\eta$ is plotted against percentage solids for a typical No. 2 coating clay. As is well-known, the slurry viscosity $\eta$ is directly related to the solids content S of the particular slurry under consideration. The graph illustrates that production maximizes at about 40% solids; and further shows than any value between 27 to 59% solids (by weight of slurry) yields at least 90% of that maximum value. The existence of a maximum in production rate is directly a function of the viscosity dependence of the magnetic separation parameter p. Everything else being equal, maximum production capacity (for a desired brightness increase) can therefore be achieved with 35% slurry. But since about 80% of maximum production is achievable for even 20% packing and 30% solids, the range 20–35% for packing density, and 30–40% solids may be more generally regarded as preferred operating ranges where production is to be maximized for a desired brightness increase.

While the present invention has been particularly set forth in terms of specific embodiments thereof, it will be understood in view of the instant disclosure, that numerous variations upon the invention are now enabled to those skilled in the art, which variations yet reside within the scope of the instant teaching. Accordingly, the invention is to be broadly construed, and limited only by the scope and spirit of the claims now appended hereto.

We claim:

1. An improved method for effecting magnetic separation of magnetically attractable discolorant particles from an aqueous clay slurry including said particles, applicable to a process of magnetic separation comprising passing a slurry, having a solids content, S, of from 27% to 60% clay solids by weight of the slurry, through a ferromagnetic filamentatious matrix within a non-magnetic canister disposed in a magnetic field; said matrix forming part of a magnetic separator system characterized by the parameters Q, d, $\eta$, M, X, H and $\tau$ where Q is the magnetic susceptibility and d the mean diameter of said attractable particles, $\eta$ is the slurry viscosity and is a function of the solids content, S, of the slurry; M the magnetization and D the mean diameter of the filaments of said matrix, X is the fraction of said canister volume occupied by said matrix, H is the intensity of the applied magnetic field, and $\tau$ is the retention time for said dispersion in said field; and in which the operation of said system being effected under the constraint of yielding a desired $C_o/C$ ratio, where C is the number of said discolorant particles entering said system and $C_o$ is the number leaving said system, thereby yielding a desired brightness increase for said clay; said parameters being selected in accordance with the relationship $C_o/C = e^{-\alpha p}$ where $\alpha$ is a numerical coefficient characteristic of the system, and p is the system separation parameter and interrelates said parameters by the expression:

$$p = Q/\eta(d/D)^2 M\tau H \times (1-X)$$

wherein the improvement comprises:

(1) providing a slurry having a solids content of from 27% to 60% clay solids by weight of the slurry;

(2) passing said slurry through said ferromagnetic filamentatious matrix within said non-magnetic canister disposed in a magnetic field to yield a predetermined brightness increase at a desired production rate by adjusting the packing of said non-magnetic canister with said ferromagnetic filamentatious matrix so that from 0.20 to 0.45 of said canister volume is occupied by said matrix and said predetermined brightness increase and desired production rate are obtained.

* * * * *

UNITED STATES PATENT AND TRADEMARK OFFICE

CERTIFICATE OF CORRECTION

PATENT NO. : 4,157,954

DATED : June 12, 1979

INVENTOR(S) : Robin R. Oder

It is certified that error appears in the above-identified patent and that said Letters Patent are hereby corrected as shown below:

In title at No. [54] and Column 1, "BENEFICATION" should be -- BENEFICIATION --.

In Column 1, line 20, "definitiely" should be -- definitely --.

Column 1, line 37, the word "are" (second instance) should be -- of --.

Column 2, line 27, "hae" should be -- have --.

Column 2, line 37, following "consequence", a comma -- , -- should be inserted.

Column 2, line 38, following "type", the comma "," should be omitted.

Column 6, line 21 and Equation (10), "W" should be -- $\mathring{W}$ --.

Column 9, line 62, "rentention" should be -- retention --.

Column 11, line 14, "than" should be -- that --.

Column 12, line 25, the equation should read:

-- $p = \frac{Q}{\eta} (d/D)^2 M \tau H X (1-X)$ --.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*